US010901447B2

(12) United States Patent
Chien

(10) Patent No.: US 10,901,447 B2
(45) Date of Patent: Jan. 26, 2021

(54) POWER AMPLIFIER AND TEMPERATURE COMPENSATION METHOD FOR THE POWER AMPLIFIER

(71) Applicant: RICHWAVE TECHNOLOGY CORP., Taipei (TW)

(72) Inventor: Hwey-Ching Chien, Taipei (TW)

(73) Assignee: RichWave Technology Corp., Taipei (TW)

( * ) Notice: Subject to any disclaimer, the term of this patent is extended or adjusted under 35 U.S.C. 154(b) by 13 days.

(21) Appl. No.: 16/575,513

(22) Filed: Sep. 19, 2019

(65) Prior Publication Data

US 2020/0341501 A1 Oct. 29, 2020

(30) Foreign Application Priority Data

Apr. 23, 2019 (TW) ..... 108114104 A

(51) Int. Cl.
*G05F 3/24* (2006.01)
*G05F 3/26* (2006.01)
*G05F 3/22* (2006.01)

(52) U.S. Cl.
CPC ..... *G05F 3/245* (2013.01); *G05F 3/225* (2013.01); *G05F 3/262* (2013.01); *G05F 3/265* (2013.01)

(58) Field of Classification Search
CPC ..... G05F 3/245
See application file for complete search history.

(56) References Cited

U.S. PATENT DOCUMENTS 3,893,018 A 7/1975 Marley
4,887,181 A * 12/1989 Lenz ..... H02H 5/044 361/103
5,530,340 A 6/1996 Hayakawa et al.
5,923,217 A 7/1999 Durec
5,926,062 A 7/1999 Kuroda
6,201,381 B1 3/2001 Yasuda
6,259,324 B1 * 7/2001 Antognetti ..... G05F 1/565 323/314
7,355,480 B2 4/2008 Honda
7,920,015 B2 4/2011 Chellappa
2006/0001412 A1 1/2006 Fernald
2007/0222520 A1 * 9/2007 Inamori ..... H03F 1/30 330/289
2011/0193544 A1 8/2011 Iacob et al.
(Continued)

*Primary Examiner* — Patricia T Nguyen
(74) *Attorney, Agent, or Firm* — Winston Hsu

(57) ABSTRACT

A power amplifier configured to amplify a received input signal, and the power amplifier includes a bias circuit and an output stage circuit. The bias circuit includes a reference voltage circuit and a bias generating circuit. The reference voltage circuit receives the first system voltage and provides a reference voltage according to a first system voltage, and the reference voltage changes as the temperature of the wafer changes. The bias generating circuit receives the second system voltage and the reference voltage, and generates an operating voltage. The output stage circuit is coupled to the bias circuit to receive the operating voltage and the driving current to receive and amplify the input signal. When a chip temperature is changed, the bias generating circuit changes the operating voltage according to the reference voltage, such that the driving current approaches a predetermined value as the chip temperature rises.

20 Claims, 10 Drawing Sheets

(56) References Cited

U.S. PATENT DOCUMENTS

| | | | | |
|---|---|---|---|---|
| 2012/0178384 | A1* | 7/2012 | Andrys | H03F 3/189<br>455/73 |
| 2013/0049871 | A1* | 2/2013 | Schooley | H03F 3/19<br>330/296 |
| 2013/0293215 | A1 | 11/2013 | Lym et al. | |
| 2014/0375371 | A1 | 12/2014 | Park | |
| 2016/0091917 | A1 | 3/2016 | Imura | |

* cited by examiner

POWER AMPLIFIER AND TEMPERATURE COMPENSATION METHOD FOR THE POWER AMPLIFIER

CROSS-REFERENCE TO RELATED PATENT APPLICATION

This application claims the benefit of priority to Taiwan Patent Application No. 108114104, filed on Apr. 23, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a power amplifier and a temperature compensation method for the power amplifier, in particular to a power amplifier and a temperature compensation method for the power amplifier capable of stably operating under temperature variations.

BACKGROUND OF THE DISCLOSURE

In existing mobile communication systems, a power amplifier is a critical component and a major energy consuming part. Efficiency and linearity of the power amplifier will directly affect communication quality of communication terminals. Therefore, the power amplifier must meet the efficiency requirements in addition to strict linear characteristics.

Technology applied to power amplifier design mainly uses III-V compound and silicon processing techniques. In order to implement designs of high-performance RF power amplifiers, not only basic indicators such as linearity and efficiency, but also temperature compensation mechanism must be considered.

In a design of an existing bias circuit, standby currents of power amplifiers continue to increase as temperature increases, resulting in deterioration of thermal reliability of the power amplifiers, which are highly likely to be damaged due to high temperature.

Therefore, improving a temperature stability of the power amplifier through improvements in circuit design has become an important topic in the arts.

SUMMARY OF THE DISCLOSURE

In response to the above-referenced technical inadequacies, the present disclosure provides a power amplifier and a temperature compensation method for the power amplifier that can stably operate under temperature changes.

In one aspect, the present disclosure provides a power amplifier configured to amplify an input signal received thereby, the power amplifier includes a bias circuit and an output stage circuit, and the bias circuit includes a reference voltage circuit and a bias generating circuit. The reference voltage circuit is configured to receive a first system voltage, the reference voltage circuit provides a reference voltage according to the first system voltage, and the reference voltage changes as a chip temperature changes. The bias generating circuit is electrically coupled to the reference voltage circuit and configured to receive a second system voltage and the reference voltage and generate an operating voltage. The output stage circuit is electrically coupled to the bias circuit, and the output stage circuit is configured to receive the operating voltage and a driving current to receive and amplify the input signal. The bias generating circuit is configured to change the operating voltage according to the reference voltage in responsive to the chip temperature changes, such that the driving current approaches a predetermined value as the chip temperature rises.

In one aspect, the present disclosure provides a temperature compensation method for a power amplifier, and the method is used for compensating a driving current of the power amplifier. The power amplifier is configured to amplify a received input signal and includes a bias circuit and an output stage circuit, and the bias voltage circuit includes a reference voltage circuit and a bias generating circuit. The temperature compensation method includes: configuring the reference voltage circuit to receive a first system voltage and providing a reference voltage according to the first system voltage, and the reference voltage changes as a chip temperature changes; configuring a bias generating circuit to receive a second system voltage and the reference voltage, and generating an operating voltage; configuring an output stage circuit to receive the operating voltage and a driving current to receive and amplify the input signal; and the bias generating circuit being configured to change the operating voltage according to the reference voltage in responsive to the chip temperature changes, such that the driving current approaches a predetermined value as the chip temperature rises.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
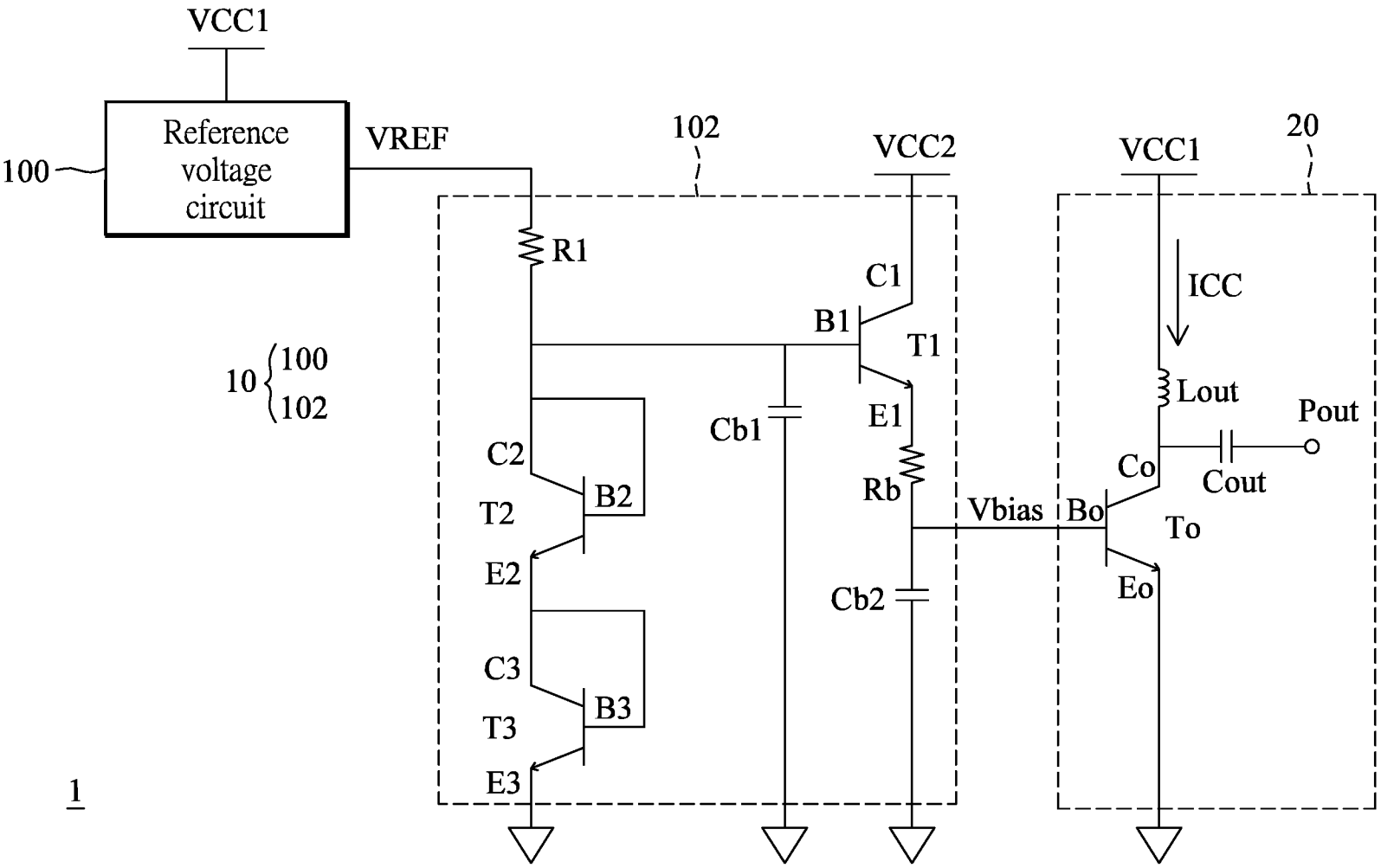
FIG. 1 is a circuit diagram of a power amplifier according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

FIG. 1 is a circuit diagram of a power amplifier according to a first embodiment of the present disclosure. Reference is made to FIG. 1, the first embodiment of the present disclosure provides a power amplifier 1, which is configured to amplify an input signal, such as a radio frequency (RF) signal, received thereby, and the power amplifier 1 includes a bias circuit 10 and an output stage circuit 20. In detail, the power amplifier of the present disclosure is designed to reduce or cancel temperature dependence during an operation of the power amplifier. Therefore, the bias circuit 10 includes two parts, one of which is a bias generating circuit 102, the other one is a reference voltage circuit 100.

The bias generating circuit 102 is electrically coupled to the reference voltage circuit 100 and configured to receive a system voltage VCC2 and a reference voltage VREF and generate an operating voltage Vbias correspondingly. The output stage circuit 20 is electrically coupled to the bias circuit 10 and configured to receive the operating voltage Vbias and a driving current ICC from a system voltage VCC1 to receive and amplify the input signal.

In one embodiment, the bias generating circuit 102 may include a transistor T1. The transistor T1 has a first end configured to receive a system voltage VCC2, a second end coupled to the output stage circuit to provide the operating voltage Vbias, and a third end configured to receive the reference voltage VREF. In another embodiment, the bias generating circuit 102 may include a transistor T1, a bias resistor Rb, and a resistor R1. The transistor T1 has a first end configured to receive a system voltage VCC2 and, a second end coupled to the output stage circuit through the bias resistor Rb, and a third end configured to receive the reference voltage VREF through the resistor R1. In the present embodiment, the bias generating circuit 102 may include a transistor T1, a transistor T2, and a transistor T3. As shown in FIG. 1, the transistor T1 has a first end, for example, a collector C1 configured to receive a system voltage VCC2, and a second end, such as an emitter E1 coupled to one end of a bias resistor Rb and the output stage circuit 20 through a bias resistor Rb. Another end of the bias resistor Rb is coupled to a common terminal through a bias capacitor Cb2. In an embodiment, the common end may be a ground end, and the system voltage VCC1 and the system voltage VCC2 may be different voltages, or may be a same voltage, such as a power supply voltage.

The transistor T2 has one end, for example, a collector C2 configured to receive the reference voltage VREF through the resistor R1 and coupled to a third end, such as a base B1 of the transistor T1, and a third end, such as a base B2 coupled to the base B1 of the transistor T1 and short-circuited with the collector C2, and the third end of the transistor T2 is also coupled to the common end through a bias capacitor Cb1.

The transistor T3 has a first end, such as a collector C3 coupled to the emitter E2 of the transistor T2, and a second end, such as an emitter E3 coupled to the common terminal, and a third end, such as a base B3 short-circuited with the collector C3. Herein, the transistor T2 and the transistor T3 are used as diodes, which may be transistors being configured in a form of the diode and used for rectification or voltage shifting.

On the other hand, the output stage circuit 20 can include an output inductor Lout, an output capacitor Cout, and an output transistor To. Herein, a first end of the output transistor To, such the collector Co, receives the system voltage VCC1 and the driving current ICC through the output inductor Lout, and the collector Co is coupled to an output end through the output capacitor Co. A second end of the output transistor To, such as an emitter Eo, is coupled to the common end, that is, the ground end, and a third terminal of the output transistor To, for example, the base Bo, is configured to receive the operating voltage Vbias. The output transistor To is further configured to input an input signal to be amplified at a third end of the output transistor To, for example, an RF signal to be amplified, and after the input signal is amplified, the amplified input signal is output at the first end of the output transistor To.

In the present embodiment, the reference voltage circuit 100 is configured to provide a reference voltage VREF to design a voltage reference whose characteristics will be used to reduce or cancel the temperature dependence of the power amplifier 1, such that an output power or an Error Vector Magnitude (EVM) of the power amplifier 1 remains approximately constant in a range of temperature variation. The reference voltage circuit 100 can be configured to receive the system voltage VCC1, and the reference voltage circuit 100 provides the reference voltage VREF according to the system voltage VCC1. In this case, the reference voltage VREF changes as a chip temperature changes. In one embodiment, the power amplifier 1 is disposed in a chip, and the chip temperature can be, for example, a temperature near a periphery of the chip, or an internal temperature of the chip. The chip temperature could be sensed by a sensing circuit, which may include a diode.

Therefore, when the chip temperature changes, the bias generating circuit 102 can change the operating voltage Vbias according to the reference voltage VREF by a configuration depicted in FIG. 1, such that the driving current ICC approaches a predetermined value as the chip temperature rises, thereby stabilizing the output power or the EVM of the power amplifier 1. In other words, when the driving current ICC approaches the predetermined value set, a changing rate of the output power Pout of the output stage circuit 20 can be made to change with the chip temperature in a predetermined temperature interval, for example, −40° C. to 80° C., to be less than a predetermined rate, for example, ±10%, thereby causing a changing rate of the EVM vary with the chip temperature to be less than another corresponding predetermined range.

This embodiment is mainly used to explain a basic architecture of the power amplifier of the present disclosure, and an example of a specific configuration of the reference voltage circuit 100 will be described in detail hereinafter. Further, in the following embodiments, although most of transistors are illustrated by junction transistors, the transistors may be substituted by field effect transistors in other embodiments.

Second Embodiment

Figure 2:
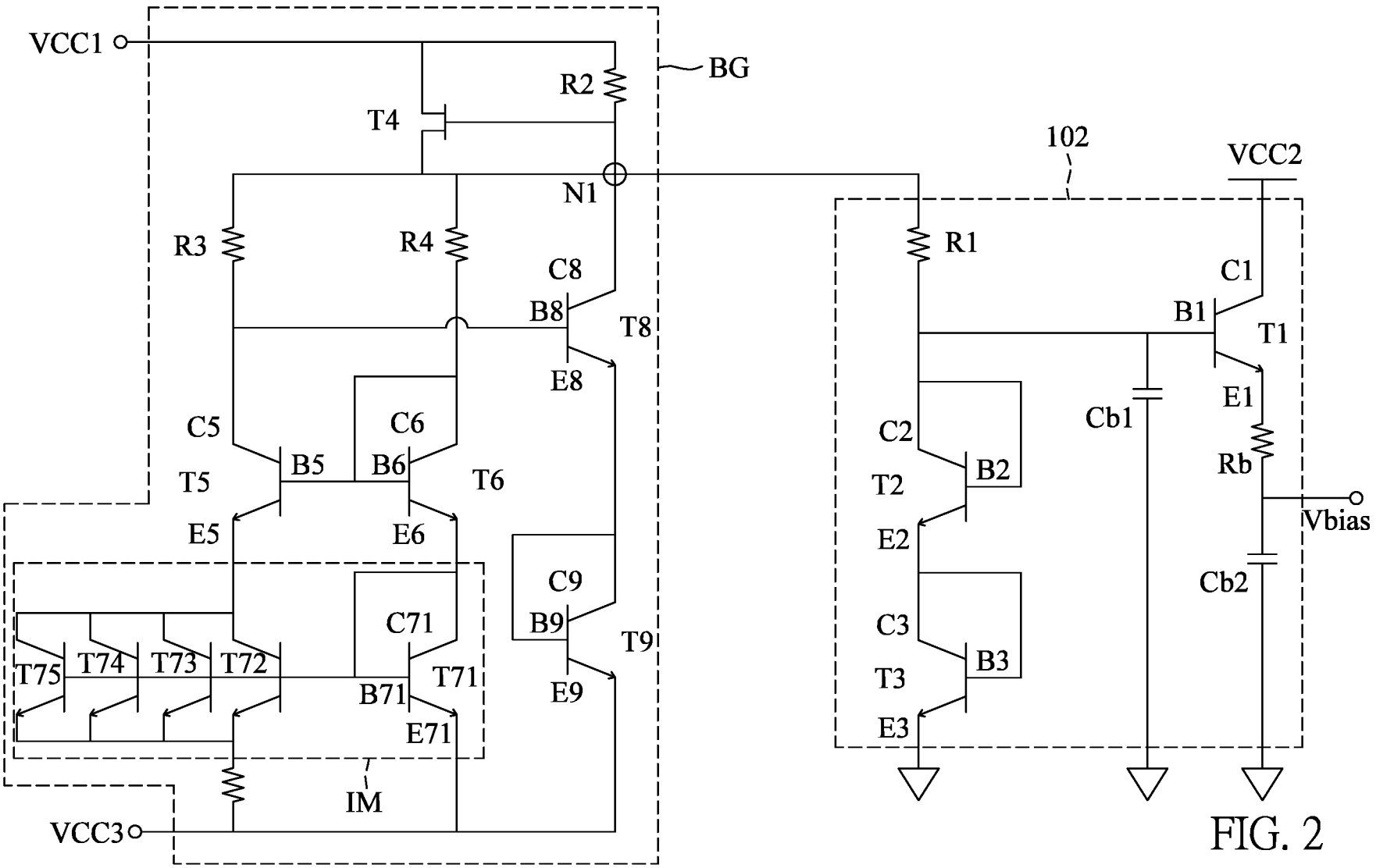
FIG. 2 is a circuit diagram of a power amplifier according to a second embodiment of the present disclosure.

Reference is made to FIG. 2, which is a circuit diagram of a power amplifier according to a second embodiment of the present disclosure. This embodiment will further explain the details of the reference voltage circuit 100, and an architecture of the bias generating circuit 102 is the same as that of the first embodiment. As shown, the reference voltage circuit 100 can be a bandgap reference voltage circuit BG, which includes a transistor T4, a transistor T5, a transistor T6, a current mirror circuit IM, a transistor T8, a transistor T9, a resistor R2, a resistor R3 and a resistor R4.

The transistor T4 has a first end, such as a drain coupled to the system voltage VCC1, a second end, such as a source configured to receive a system voltage VCC1 through a resistor R2, and a third end, such as a gate coupled to a node N1. One end of the resistor R3 is coupled to the node N1, and one end of the resistor R4 is coupled to the node N1. The transistor T5 has a first end, such as a collector C5 coupled to another end of the resistor R3. The transistor T6 has a first end, such as a collector C6 coupled to another end of the resistor R4 and a third end, such as a base B6 short-circuited with the collector C6 and coupled to a collector B5 of the transistor T5.

The current mirror circuit IM is coupled to an emitter E5 of the transistor T5, an emitter E6 of the transistor T6, and the common end. The current mirror circuit IM includes a plurality of transistors T71, T72, . . . , T75, a base B71 of the transistor T71 is coupled to bases of the transistors T72, T73, T74, T75, a collector C71 of the transistor T71 is coupled to the emitter E6 of the transistor T6 and is short-circuited with the base B71, and the emitter E71 of the transistor T71 is coupled to the common end, such as the ground end, to receive a system voltage VCC3 and form a current mirror architecture.

In addition, the bandgap reference voltage circuit BG further includes a transistor T8 and a transistor T9. A first end of the transistor T8, such as a collector C8, is coupled to the node N1, and a third end of the transistor T8, such as a base B8, is coupled between the another end of the resistor R3 and the collector C5 of the transistor T5. The transistor T9 has a first end, such as a collector C9 coupled to an emitter E8 of the transistor T8, a second end, such as an emitter E9 coupled to the common end, and a third end, such as a base B9 short-circuited with the collector C9 of the transistor T9. Herein, in the gap reference voltage circuit BG, since the resistor R3 and the resistor R4 have temperature dependence, and a ratio of the resistor R3 and the resistor R4 also determines a magnitude of the reference voltage VREF, resistances of the resistor R3 and the resistor R4 can be adjusted to change the reference voltage VREF outputted at the node N1 according to a change in the chip temperature. The change in the reference voltage VREF with temperature will be used to reduce or cancel the temperature dependence of the power amplifier 1, such that the output power or the EVM of the power amplifier 1 remains approximately constant in a range of temperature variation. Therefore, when the chip temperature changes, the bias generating circuit 102 can change the operating voltage Vbias according to the reference voltage VREF by a configuration depicted in FIG. 1, such that the driving current ICC approaches a predetermined value as the chip temperature rises, thereby stabilizing the output power or the EVM of the power amplifier 1. In other words, when the driving current ICC approaches the set predetermined value, a changing rate of the output power Pout of the output stage circuit 20 can be made to change with the chip temperature in a predetermined temperature interval, for example, −40° C. to 80° C., to be less than a predetermined rate, for example, ±10%, thereby causing a changing rate of the EVM vary with the chip temperature to be less than another corresponding predetermined range.

Therefore, the power amplifier provided by the present disclosure can reduce or cancel the temperature dependence of the power amplifier and improve a temperature stability of the power amplifier by a cooperation of the reference voltage circuit and the bias circuit.

Third Embodiment

Figure 3:
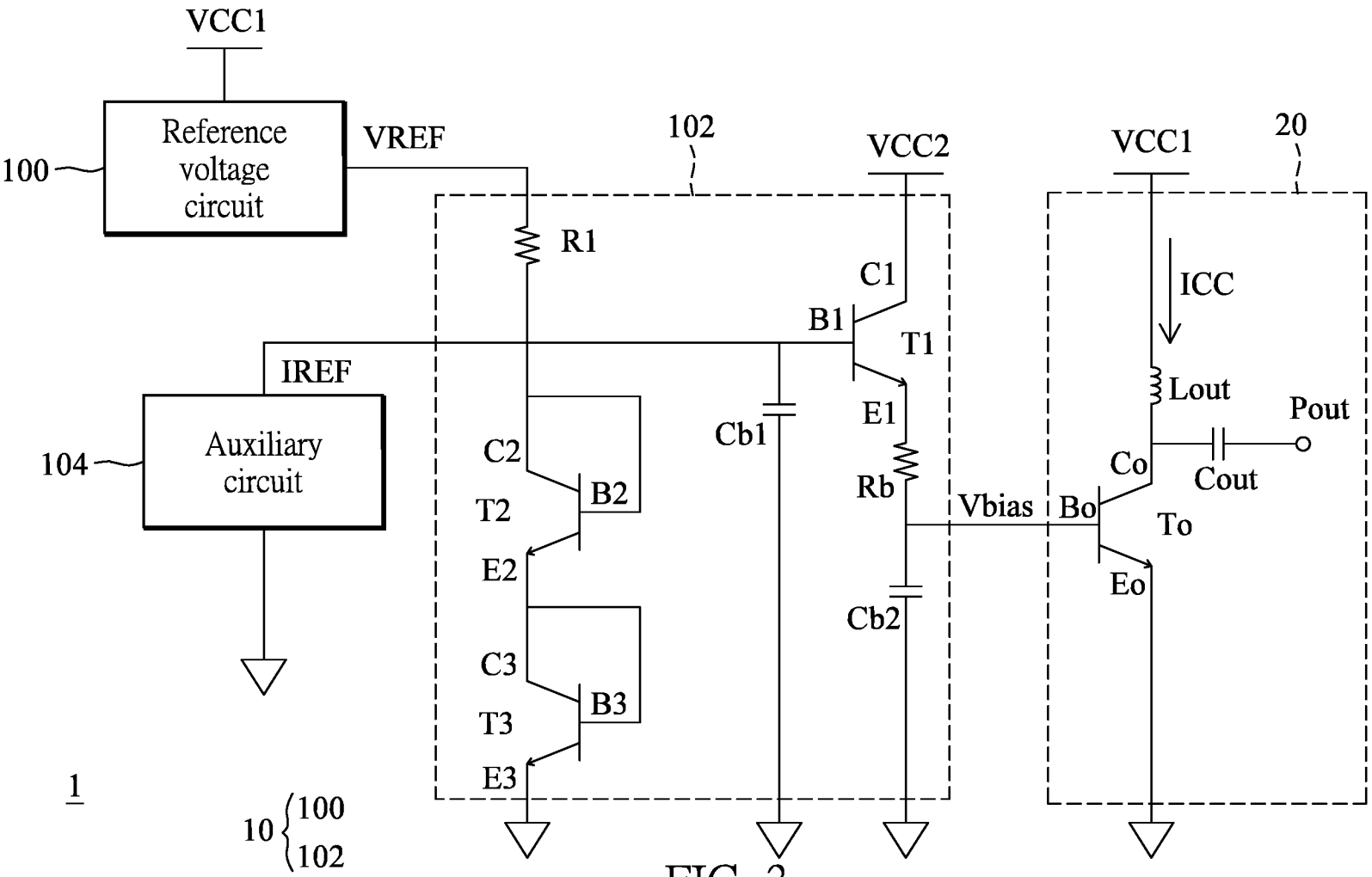
FIG. 3 is a circuit schematic diagram of a power amplifier according to a third embodiment of the present disclosure.

FIG. 3 is a circuit schematic diagram of a power amplifier according to a third embodiment of the present disclosure. Reference is made to FIG. 3, the third embodiment of the present disclosure provides another power amplifier 1 configured to amplify the input signal received thereby. The power amplifier 1 includes a bias circuit 10 and an output stage circuit 20. In detail, the power amplifier of the present embodiment is also designed to reduce or cancel a temperature dependence during an operation of the power amplifier, and the difference between the third embodiment and the previous embodiment is that the bias circuit 10 includes three parts, one of which is a bias generating circuit 102, another one is a reference voltage circuit 100, and the other one is an auxiliary circuit 104. The bias generating circuit 102 is electrically coupled to the reference voltage circuit 100 and the auxiliary circuit 104 and configured to receive a system voltage VCC2, a reference voltage VREF from the reference voltage circuit 100 and a reference current IREF changed by the auxiliary circuit 104, and generate an operating voltage Vbias. In the embodiment of FIG. 3, an architecture of the bias generating circuit 102 is substantially the same as that of the foregoing embodiments, except that the base B1 of the transistor T1 and the collector C2 of the transistor T2 are further coupled to the auxiliary circuit 104 to receive the reference current IREF, and the repeated descriptions are omitted hereinafter. The output stage circuit 20 is electrically coupled to the bias circuit 10 and configured to receive the operating voltage Vbias and a driving current ICC from a system voltage VCC1 to receive and amplify the input signal. Similarly, in the embodiment of FIG. 3, the architecture of the output stage circuit 20 is substantially the same as that of the previous embodiment, and therefore will not be described herein. The auxiliary circuit 104 is configured to change the reference current IREF received by the bias generating circuit 102. For example, the auxiliary circuit 104 can be used to extract a current originally flowing to the base B1 of the transistor T1, and the more current is extracted as the temperature rises. In a case that the bias voltage generating circuit 102 receives the system voltage VCC2, the reference voltage VREF, and the reference current IREF, the operating voltage Vbias is generated according to the system voltage VCC2, the reference voltage VREF, and the reference current IREF. Therefore, the system voltage VCC2, the reference voltage VREF, and the reference current IREF determine a trend of the operating voltage Vbias. In this case, when the chip temperature is changed, the designed auxiliary circuit 104 will change the reference current IREF as the chip temperature changes, and the bias generating circuit 102 will change the operating voltage Vbias according to the reference voltage VREF and the reference current IREF, such that the driving current ICC approaches a predetermined value as the chip temperature rises, thereby stabilizing the output power or the EVM of the power amplifier 1. Therefore, when the driving current ICC approaches the set predetermined value, a changing rate of the output power Pout of the output stage circuit 20 can be made to change with the chip temperature in a predetermined temperature interval, for example, −40° C. to 80° C., to be less than a predetermined rate, for example, ±10%, thereby causing a changing rate of the EVM vary with the chip temperature to be less than another corresponding predetermined range. The present embodiment is mainly for explaining a basic architecture of the third embodiment of the power amplifier of the present disclosure, and an example of a specific configuration of the reference voltage circuit 100 and the auxiliary circuit 104 will be described in detail hereinafter.

Fourth Embodiment

Figure 4A:
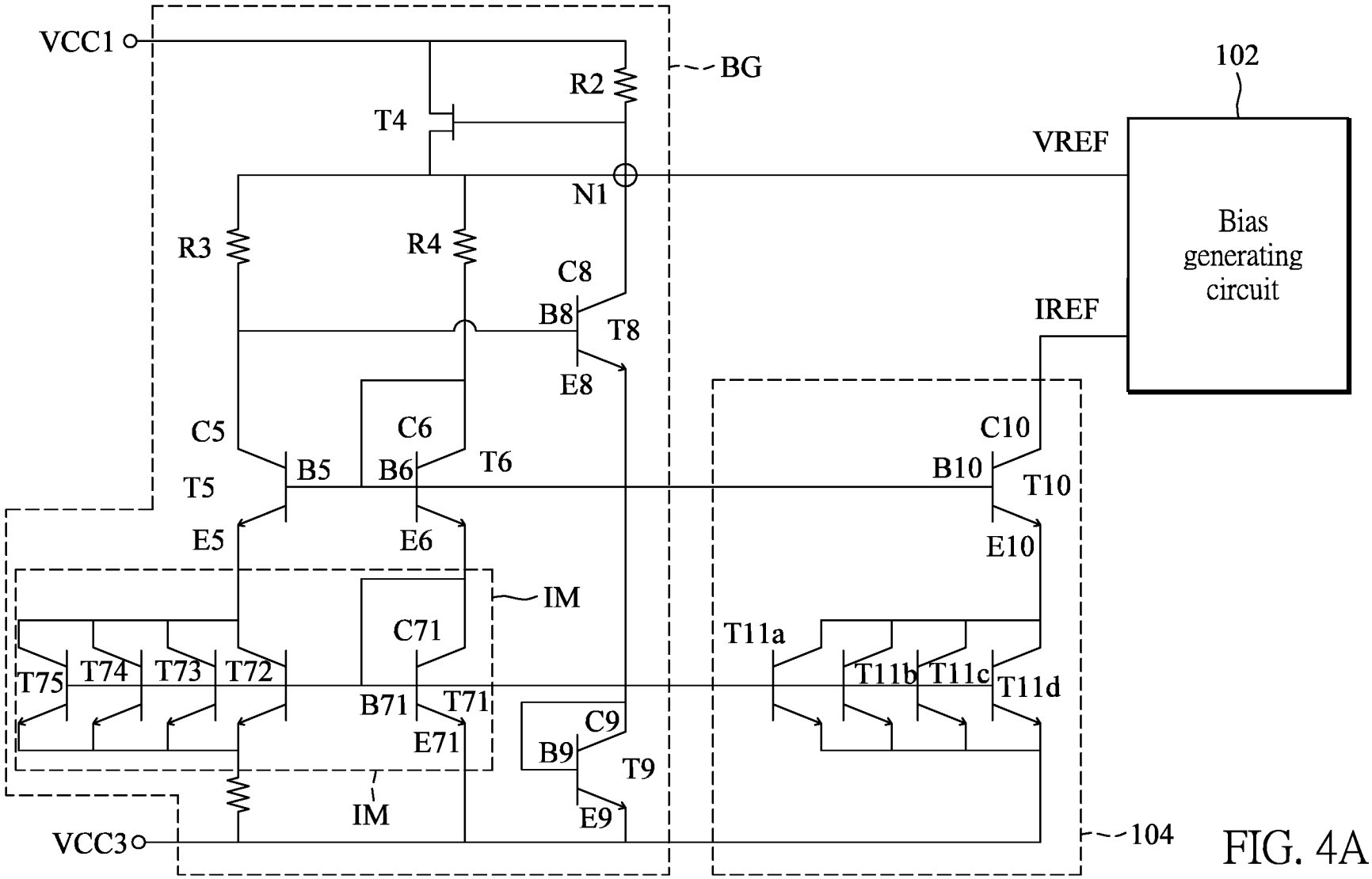
FIG. 4A is a circuit schematic diagram of a power amplifier according to a fourth embodiment of the present disclosure.
Figure 4B:
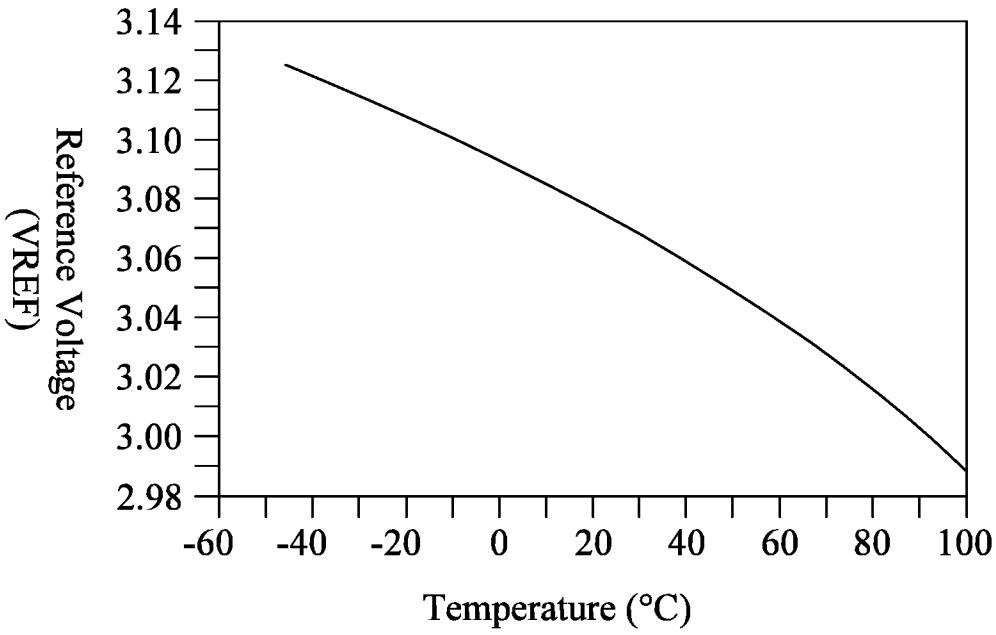
FIGS. 4B and 4C are a graph of reference voltage versus temperature of a power amplifier according to the fourth embodiment of the present disclosure, and a graph of driving current versus temperature of a power amplifier and an existing power amplifier according to the fourth embodiment of the present disclosure, respectively.
Figure 4C:
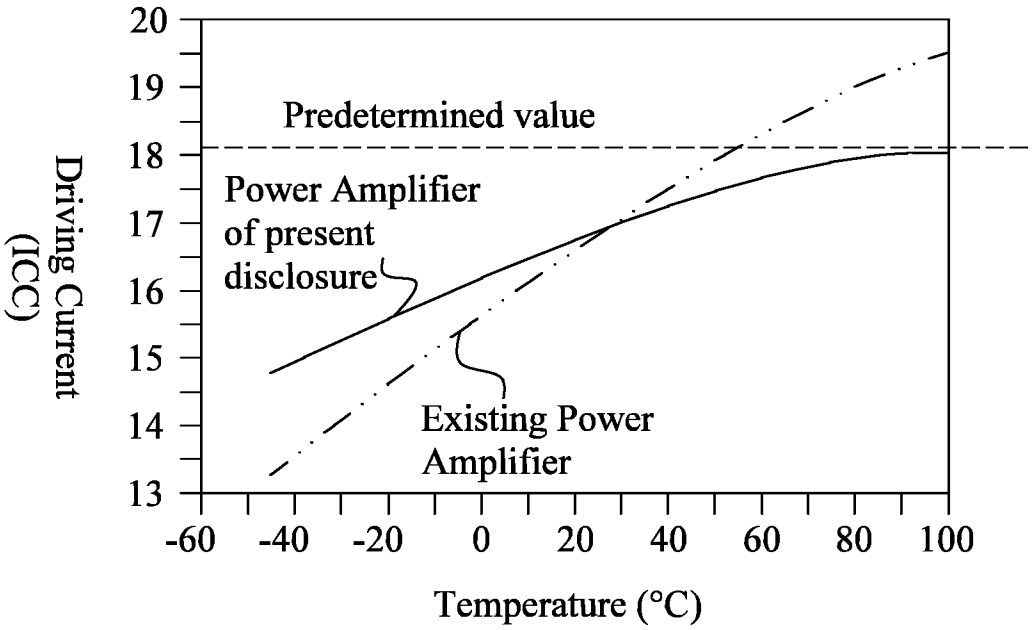

Reference is made FIG. 4A, which is a circuit schematic diagram of a power amplifier according to a fourth embodiment of the present disclosure. This embodiment will further explain the details of the reference voltage circuit 100 and the auxiliary circuit 104, and architectures of the bias generating circuit 102 and the auxiliary circuit 104 are the same as those of the second embodiment. In the present embodiment, the auxiliary circuit 104 can include a transistor T10 and a plurality of transistors T11*a*, T11*b*, T11*c* and T11*d*. A first end of the transistor T10, such as a collector C10, is coupled to the bias generating circuit 102 for changing the reference current IREF received by the transistor T10, and a third end of the transistor, such as a base B10, is coupled to the base B6 of the transistor T6. The first ends of the plurality of transistors T11*a*, T11*b*, T11*c*, and T11*d*, such as collectors, are coupled to a second end of the transistor T10, for example, an emitter E10, and are respectively coupled to the current mirror circuit IM. Furthermore, the reference current IREF may vary depending on a ratio of a number of the plurality of transistors T11*a*, T11*b*, T11*c*, T11*d* and the transistor T7, and the chip temperature. Therefore, in addition to the reference voltage VREF provided by the bandgap reference voltage circuit BG, the reference current IREF changed by the auxiliary circuit 104 will also change according to the chip temperature, and both of which will be used to reduce or cancel the temperature dependence of the power amplifier 1, such that an output power or an EVM of the power amplifier 1 remains approximately constant in a range of temperature variation. Therefore, when the chip temperature changes, the bias generating circuit 102 can change the operating voltage Vbias according to the reference voltage VREF by a configuration depicted in FIG. 1, such that the driving current ICC approaches a predetermined value as the chip temperature rises, thereby stabilizing the output power or the EVM of the power amplifier 1. In other words, when the driving current ICC approaches the set predetermined value, a changing rate of the output power Pout of the output stage circuit 20 can be made to change with the chip temperature in a predetermined temperature interval, for example, −40° C. to 80° C., to be less than a predetermined rate, for example, ±10%, thereby causing a changing rate of the EVM vary with the chip temperature to be less than another corresponding predetermined range. Therefore, the power amplifier provided by the present disclosure can reduce or cancel the temperature dependence of the power amplifier and improve a temperature stability of the power amplifier by a cooperation of the reference voltage circuit and the bias circuit. Reference is made to FIGS. 4B and 4C, which are respectively a graph of reference voltage versus temperature of a power amplifier according to the fourth embodiment of the present disclosure, and a graph of driving current versus temperature of a power amplifier and an existing power amplifier according to the fourth embodiment of the present disclosure. As shown in FIGS. 4B and 4C, as the chip temperature rises, the reference voltage VREF output by the reference voltage circuit 100 will decrease accordingly. Therefore, the reference voltage VREF can be used to reduce or cancel the temperature dependence of the power amplifier 1, such that the output power of the power amplifier 1 remains approximately constant in a range of temperature variation, thereby causing a magnitude of the EVR to remain substantially constant over in this range of temperature variation. Therefore, when the chip temperature changes, the bias generating circuit 102 can change the operating voltage Vbias according to the reference voltage VREF by a configuration depicted in FIG. 4A, such that the driving current ICC approaches a predetermined value as the chip temperature rises, and the power amplifier 1 will be provided with higher temperature stability with respect to the existing power amplifier.

Fifth Embodiment

Figure 5:
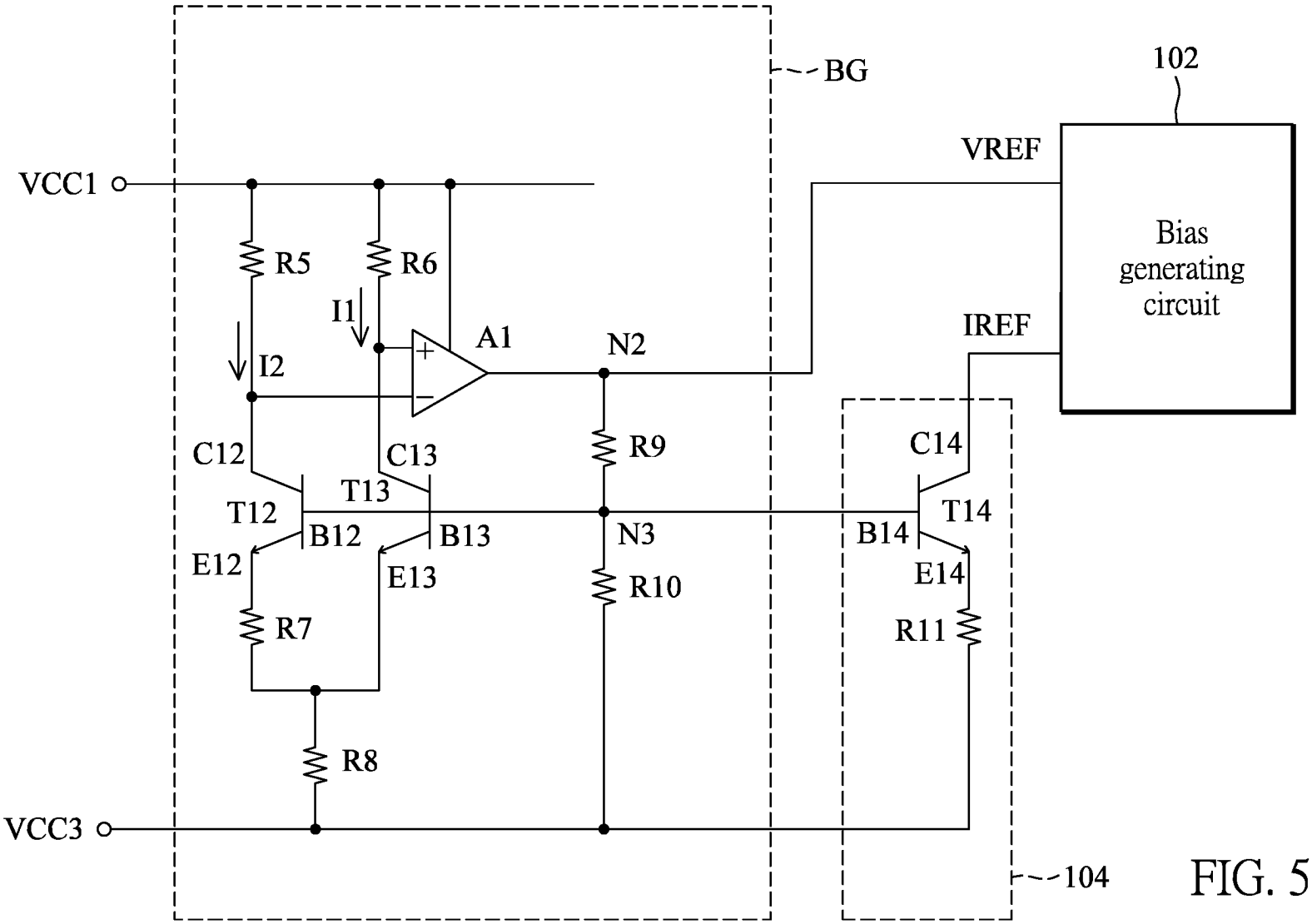
FIG. 5 is a circuit schematic diagram of a power amplifier according to a fifth embodiment of the present disclosure.

Different aspects of the bandgap reference voltage circuit BG and the auxiliary circuit 104 will be described in a fifth embodiment. Reference is made to FIG. 5, which is a circuit schematic diagram of a power amplifier according to the fifth embodiment of the present disclosure. As shown in FIG. 5, the bandgap reference voltage circuit BG can include an amplifier A1, a transistor T12, a transistor T13, a resistor R8, a resistor R9, and a resistor R10. In this case, a first input end (negative end) of the amplifier A1 receives the system voltage VCC1 through the resistor R5, a second input end (positive end) of the amplifier A1 receives the system voltage VCC1 through the resistor R6, and an output end is coupled to a node N2. The transistor T12 has a first end, such as a collector C12 coupled to the first input end of the amplifier A1, a second end, such as an emitter E12 coupled to one end of a resistor R7, and a third end, such as a base B12 coupled to node N3. A first end of the transistor T11, such as a collector C13, is coupled to the second input end of the amplifier A1, and a second end of the transistor T11, such as an emitter E13, is coupled to another end of the resistor R7, and the third end of the transistor T11, such as a base B13, is coupled to the node N3. In addition, the resistor R8 is coupled to the another end of the resistor R7 and configured to receive the system voltage VCC3, the resistor R9 is coupled between the node N2 and the node N3, one end of the resistor R10 is coupled to the node N3, and another end of the resistor R10 is coupled to the common end to receive the system voltage VCC3. In the present architecture, the bandgap reference voltage circuit BG can change the reference voltage VREF output from the node N2 according to the chip temperature. Since a forward bias of a PN junction diode has a negative temperature coefficient, the bandgap reference voltage circuit BG with a non-zero temperature coefficient can be constructed by using a changing rate of a base-emitter voltage of a bipolar transistor associated with a change in the temperature. In the present embodiment, when the chip temperature changes, different currents I1 and I2 are generated due to different current paths of the transistor T12 and the transistor T13, and the amplifier A1 is used as an error amplifier to amplify a voltage difference between the first input end and the second input end to generate the reference voltage VREF that changes with the chip temperature. Moreover, the bias circuit 10 further includes an auxiliary circuit 104 electrically coupled to the bias generating circuit 102. The auxiliary circuit 104 includes a transistor T14 and a resistor R11. A first end of the transistor T14, such as a collector C14, is coupled to the bias generating circuit 102 for outputting the reference current IREF, and a second end of the transistor T14, such as an emitter E12, is configured to receive the system voltage VCC3 through the resistor R11, and a third end of the transistor T14, such as a base B14, is coupled to the node N3 Similarly, a reference current generating circuit, that is, the auxiliary circuit 104 with a non-zero temperature coefficient can be constructed by using a changing rate of a base-emitter voltage of a bipolar transistor associated with the change in the temperature. In addition, the reference current IREF received by the bias generating circuit 102 can be changed by adjusting a ratio of a resistance of the resistor R11 to a resistance of the resistor R8. For example, the resistance of the resistor R11 can be twice of the resistance of the resistor R8. In other words, the bias generating circuit 102 can receive the system voltage VCC2, the reference voltage VREF, and the reference current IREF, and generate the operating voltage Vbias. Therefore, when the chip temperature is changed, in addition to the change of the reference voltage VREF, since the designed auxiliary circuit 104 can cause the reference current IREF to be changed as the chip temperature changes, the bias generating circuit 102 will change the operating voltage Vbias according to the reference voltage VREF and the reference current IREF, such that the driving current ICC approaches a predetermined value as the chip temperature rises, thereby stabilizing the output power or the EVM of the power amplifier 1. The bias generating circuit 102 can change the operating voltage Vbias according to the reference voltage VREF by a configuration depicted in FIG. 5, such that the driving current ICC approaches the predetermined value as the chip temperature rises, thereby stabilizing the output power or the EVM of the power amplifier 1. In other words, when the driving current ICC approaches the set predetermined value, a changing rate of the output power Pout of the output stage circuit 20 can be made to change with the chip temperature in a predetermined temperature interval, for example, −40° C. to 80° C., to be less than a predetermined rate, for example, ±10%, thereby causing a changing rate of the EVM vary with the chip temperature to be less than another corresponding predetermined range.

Sixth Embodiment

Figure 6:
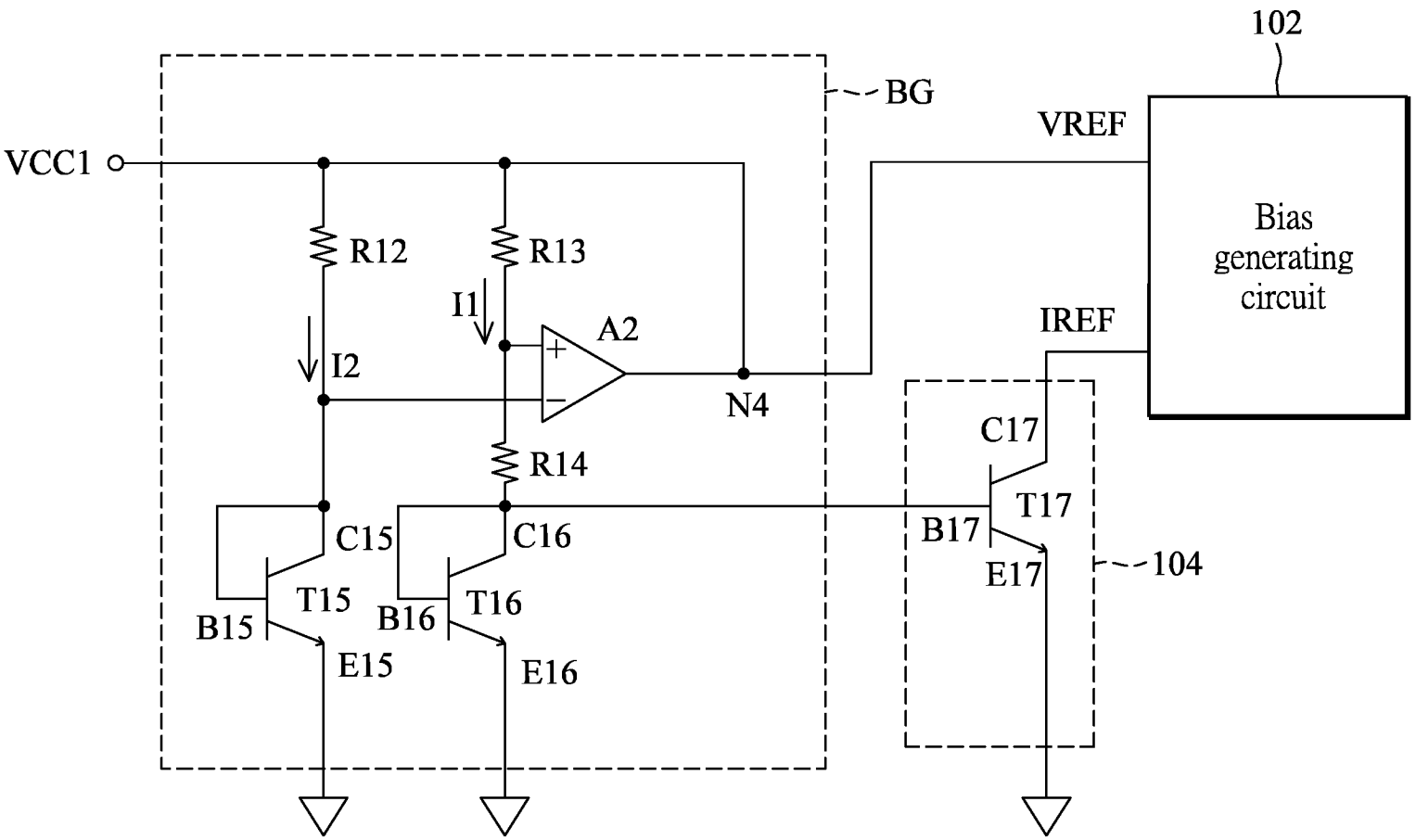
FIG. 6 is a circuit schematic diagram of a power amplifier according to a sixth embodiment of the present disclosure.

In a sixth embodiment, different aspects of the bandgap reference voltage circuit BG and the auxiliary circuit 104 will be described. Reference is made to FIG. 6, which is a circuit schematic diagram of a power amplifier according to the sixth embodiment of the present disclosure. As shown in FIG. 6, the bandgap reference voltage circuit BG can include an amplifier A2, a transistor T15, and a transistor T16. A first input end (negative end) of the amplifier A2 receives the system voltage VCC1 through the resistor R12, a second input end (positive end) of the amplifier A2 receives the system voltage VCC1 through the resistor R13, and an output end is coupled to a node N4. A first end of the transistor T15, such as a collector C15, is coupled to the second input end of the amplifier A2, and a second end of the transistor T15, such as an emitter E15, is coupled to the common end, and a third end of the transistor T15, such as a base B15, is coupled to the collector C15. A first end of the transistor T16, such as a collector C16, is coupled to the second input end of the amplifier A2 through the resistor R14, and a second end of the transistor T16, such as an emitter E16, is coupled to the common end, and a third end of the transistor T16, such as a base B16, is coupled to the collector C16. In the present architecture, the bandgap reference voltage circuit BG can change the reference voltage VREF output from the node N4 according to the chip temperature. Since a forward bias of a PN junction diode has a negative temperature coefficient, the bandgap reference voltage circuit BG with a non-zero temperature coefficient can be constructed by using a changing rate of a base-emitter voltage of a bipolar transistor associated with a change in the temperature. In the present embodiment, when the chip temperature changes, different currents I1 and I2 are generated by the resistor R14 due to different current paths of the transistor T15 and the transistor T16, and the amplifier A2 is used as an error amplifier to amplify a voltage difference between the first input end and the second input end to generate the reference voltage VREF that changes with the chip temperature. Moreover, the bias circuit 10 further includes an auxiliary circuit 104 electrically coupled to the bias generating circuit 102. The auxiliary circuit 104 includes a transistor T17. A first end of the transistor T17, such as a collector C17, is coupled to the bias generating circuit 102 for outputting the reference current IREF, and a second end of the transistor T17, such as an emitter E17, is coupled to the common end, and a third end of the transistor T17, such as a base B17, is coupled to the collector C16. Similarly, a reference current generating circuit, that is, the auxiliary circuit 104 with a non-zero temperature coefficient can be constructed by using a changing rate of a base-emitter voltage of a bipolar transistor associated with a change in the temperature. In addition, the reference current IREF received by the bias generating circuit 102 can be changed by adjusting a resistance of the resistor R14. In other words, the bias generating circuit 102 can receive the system voltage VCC2, the reference voltage VREF, and the reference current IREF, and generate the operating voltage Vbias. Therefore, when the chip temperature is changed, in addition to the change of the reference voltage VREF, since the designed auxiliary circuit 104 can cause the reference current IREF to be changed as the chip temperature changes, the bias generating circuit 102 will change the operating voltage Vbias according to the reference voltage VREF and the reference current IREF, such that the driving current ICC approaches a predetermined value as the chip temperature rises, thereby stabilizing the output power or the EVM of the power amplifier 1. In other words, when the driving current ICC approaches the set predetermined value, a changing rate of the output power Pout of the output stage circuit 20 can be made to change with the chip temperature in a predetermined temperature interval, for example, −40° C. to 80° C., to be less than a predetermined rate, for example, ±10%, thereby causing a changing rate of the EVM vary with the chip temperature to be less than another corresponding predetermined range.

Seventh Embodiment

Figure 7:
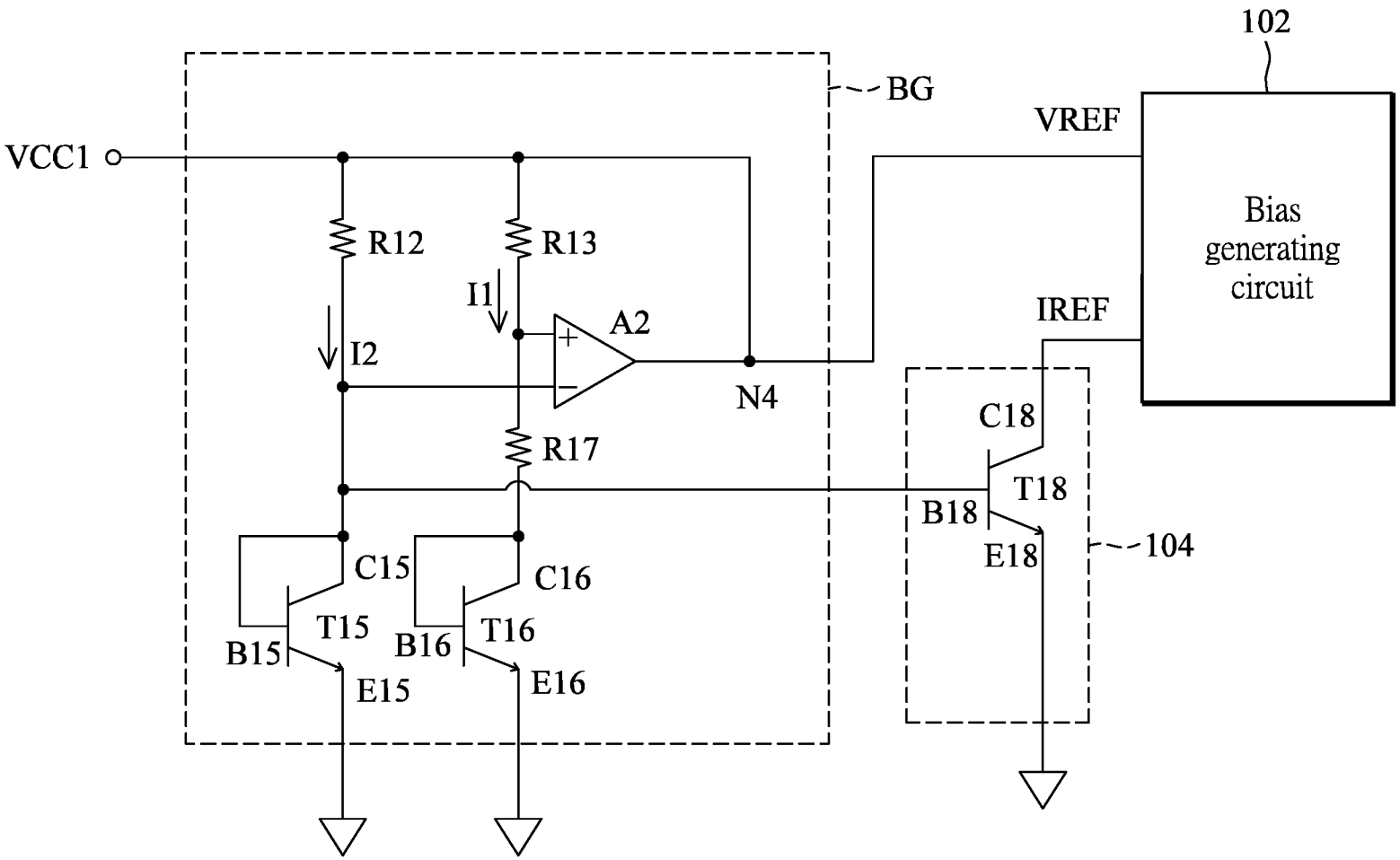
FIG. 7 is a circuit schematic diagram of a power amplifier according to a seventh embodiment of the present disclosure.

In a seventh embodiment, different aspects of the bandgap reference voltage circuit BG and the auxiliary circuit 104 will be additionally described. Reference is made to FIG. 7, which is a circuit schematic diagram of a power amplifier according to the seventh embodiment of the present disclosure. As shown in FIG. 7, similarly, a bandgap reference voltage circuit BG is the same as that of the sixth embodiment, and can include an amplifier A2, a transistor T15, and a transistor T16, except that the auxiliary circuit 104 includes a transistor T18. A first end of the transistor T18, such as a collector C18, is coupled to the bias generating circuit 102 and outputs the reference current IREF, and a second end of the transistor T18, such as an emitter E18, is coupled to the common end, and a third end of the transistor T18, such as a base B18, is coupled to the collector C15 of the transistor T15. In the present architecture, the bandgap reference voltage circuit BG can change the reference voltage VREF output from the node N4 according to the chip temperature. Since a forward bias of a PN junction diode has a negative temperature coefficient, the bandgap reference voltage circuit BG with a non-zero temperature coefficient can be constructed by using a changing rate of a base-emitter voltage of a bipolar transistor associated with a change in the temperature. In the present embodiment, when the chip temperature changes, different currents I1 and I2 are generated by the resistor R14 due to different current paths of the transistor T15 and the transistor T16, and the amplifier A2 is used as an error amplifier to amplify a voltage difference between the first input end and the second input end to generate the reference voltage VREF that changes with the chip temperature. Similarly, the auxiliary circuit 104 with a non-zero temperature coefficient can be constructed by using a changing rate of a base-emitter voltage of a bipolar transistor associated with a change in the temperature. In addition, the outputted reference current IREF can be changed by adjusting a resistance of the resistor R12. In other words, the bias generating circuit 102 can receive the system voltage VCC2, the reference voltage VREF, and the reference current IREF, and generate the operating voltage Vbias. Therefore, when the chip temperature is changed, in addition to the change of the reference voltage VREF, since the designed auxiliary circuit 104 can cause the reference current IREF to be changed as the chip temperature changes, the bias generating circuit 102 will change the operating voltage Vbias according to the reference voltage VREF and the reference current IREF, such that the driving current ICC approaches a predetermined value as the chip temperature rises, thereby stabilizing the output power or the EVM of the power amplifier 1. In other words, when the driving current ICC approaches the set predetermined value, a changing rate of the output power Pout of the output stage circuit 20 can be made to change with the chip temperature in a predetermined temperature interval, for example, −40° C. to 80° C., to be less than a predetermined rate, for example, ±10%, thereby causing a changing rate of the EVM vary with the chip temperature to be less than another corresponding predetermined range.

Eighth Embodiment

Figure 8:
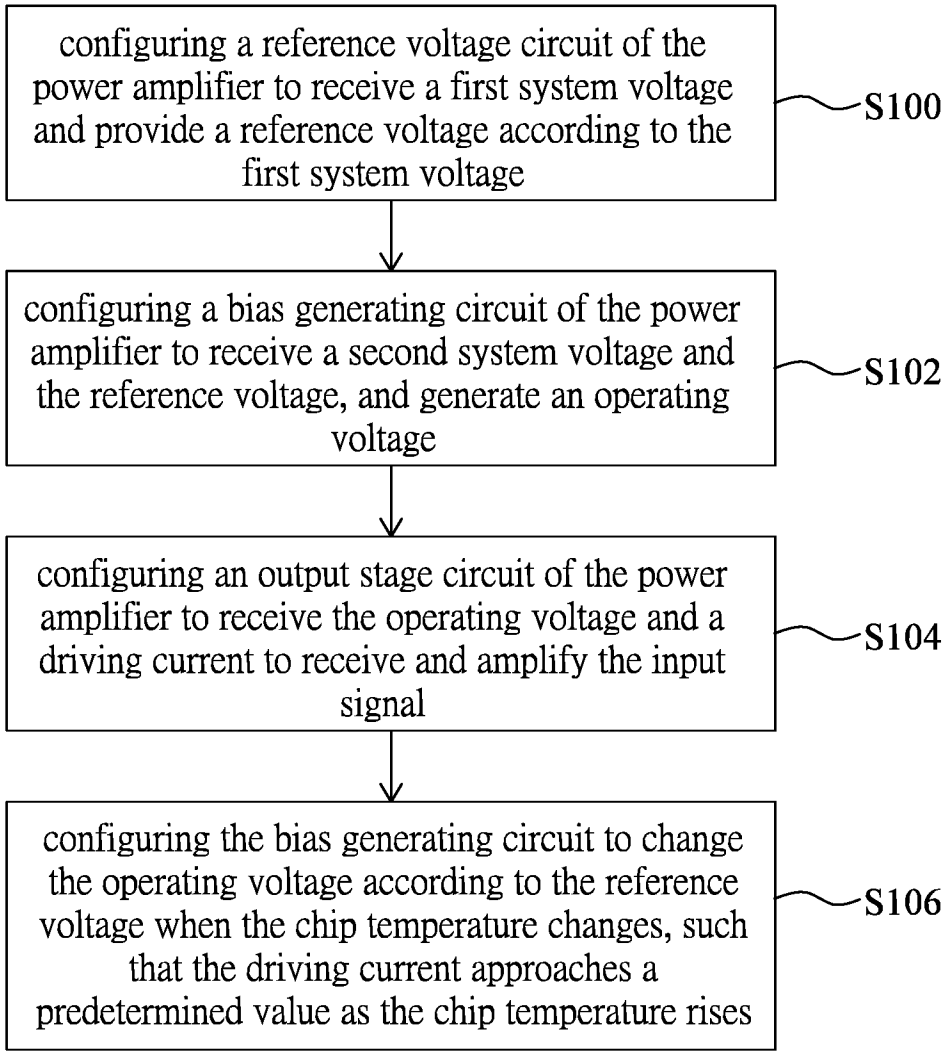
FIG. 8 is a flowchart of a temperature compensation method for a power amplifier according to an eighth embodiment of the present disclosure.

Reference is made to FIG. 8, which is a flowchart of a temperature compensation method for a power amplifier according to an eighth embodiment of the present disclosure. The eighth embodiment of the present disclosure provides a temperature compensation method for a power amplifier for compensating a driving current of the power amplifier. The temperature compensation method is applicable to the power amplifiers depicted in the first to the seventh embodiments mentioned above, and includes at least the following steps: Step S100: configuring a reference voltage circuit of the power amplifier to receive a first system voltage and providing a reference voltage according to the first system voltage. In this case, the reference voltage changes as a chip temperature changes. Step S102: configuring a bias generating circuit of the power amplifier to receive a second system voltage and the reference voltage, and generating an operating voltage. Step S103: configuring an output stage circuit of the power amplifier to receive the operating voltage and a driving current to receive and amplify the input signal.

Step S104: configuring the bias generating circuit to change the operating voltage according to the reference voltage when the chip temperature changes, such that the driving current approaches a predetermined value as the chip temperature rises. Herein, since operation manners of the power amplifiers of different aspects have been described in detail in the foregoing embodiments, the temperature compensation method for each of the embodiments will be omitted hereinafter.

In conclusion, the power amplifier and the temperature compensation method for the power amplifier provided by the present disclosure can reduce or cancel the temperature dependence of the power amplifier and improve the temperature stability of the power amplifier by the cooperation of the reference voltage circuit and the bias circuit.

Furthermore, when the chip temperature changes, the bias generating circuit 102 can change the operating voltage according to the reference voltage by the configurations depicted in the above embodiments, such that the driving current approaches the predetermined value as the chip temperature rises, thereby stabilizing the output power or the EVM of the power amplifier. In other words, when the driving current approaches the predetermined value set, the changing rate of the output power of the output stage circuit can be made to change with the chip temperature in a predetermined temperature interval to be less than a predetermined rate, thereby causing a changing rate of the EVM vary with the chip temperature to be less than another corresponding predetermined range.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A power amplifier, configured to amplify an input signal received thereby, comprising:

a bias circuit including:

a reference voltage circuit configured to receive a first system voltage, and providing a reference voltage according to the first system voltage, wherein the reference voltage changes as a chip temperature changes; and a bias generating circuit electrically coupled to the reference voltage circuit, configured to receive a second system voltage and the reference voltage, and generating an operating voltage; and an output stage circuit electrically coupled to the bias circuit, wherein the output stage circuit is configured to receive the operating voltage and a driving current to receive and amplify the input signal;

wherein the bias generating circuit is configured to change the operating voltage according to the reference voltage in responsive to the chip temperature changes, such that the driving current approaches a predetermined value as the chip temperature rises.

2. The power amplifier according to claim 1, wherein the bias generating circuit includes:

a first transistor having a first end configured to receive the second system voltage, a second end coupled to the output stage circuit through a bias resistor, and a third end configured to receive the reference voltage through a first resistor.

3. The power amplifier according to claim 2, wherein the reference voltage circuit includes a bandgap reference voltage circuit, including:

a fourth transistor having a first end coupled to the first system voltage, a second end coupled to the first system voltage through a second resistor, and a third end coupled to a first node;

a third resistor having one end coupled to the first node;

a fourth resistor having one end coupled to the first node;

a fifth transistor having a first end coupled to another end of the third resistor;

a sixth transistor having a first end coupled to another end of the fourth resistor and a third end short-circuited to the first end of the sixth transistor and coupled to the first end of the fifth transistor;

a current mirror circuit respectively coupled to the second end of the fifth transistor, a second end of the sixth transistor and a common end, including a plurality of seventh transistors, wherein the bandgap reference voltage circuit is configured to change the reference voltage output at the first node according to the chip temperature;

an eighth transistor having a first end coupled to the first node and a third end coupled between another end of the third resistor and the first end of the fifth transistor; and a ninth transistor having a first end coupled to a second end of the eighth transistor, a second end coupled to the common end, and a third end short-circuited to the first end of the ninth transistor.

4. The power amplifier according to claim 3, wherein the bias circuit further includes an auxiliary circuit electrically coupled to the bias generating circuit, configured to change a reference current, wherein the bias generating circuit is further configured to receive the second system voltage, the reference voltage, and the reference current and generate the operating voltage, wherein the auxiliary circuit is configured to cause the reference current changes as the chip temperature changes, and wherein the bias generating circuit is configured to change the operating voltage in accordance with the reference voltage and the reference current, such that the driving current approaches the predetermined value as the chip temperature rises.

5. The power amplifier according to claim 4, wherein the auxiliary circuit includes:

a tenth transistor having a first end configured to provide the reference current and a third end coupled to the third end of the sixth transistor; and a plurality of eleventh transistors each having a third end coupled to the current mirror circuit.

6. The power amplifier according to claim 5, wherein the reference current is changed according to a ratio a number of the eleventh transistors to a number of the seventh transistors, and the chip temperature.

7. The power amplifier according to claim 2, wherein the reference voltage circuit includes a bandgap reference voltage circuit, including:

a first amplifier having a first input end coupled to the first system voltage through a fifth resistor, a second input end coupled to the first system voltage through a sixth resistor, and an output end coupled to a second node;

a twelfth transistor having a first end coupled to the first input end of the first amplifier, a second end coupled to a seventh resistor, and a third end coupled to a third node;

a thirteenth transistor having a first end coupled to the second input end of the first amplifier, a second end coupled to another end of the seventh resistor, and a third end coupled to the third node;

an eighth resistor coupled to the another end of the seventh resistor and a third system voltage;

a ninth resistor coupled between the second node and the third node; and a tenth resistor coupled between the third node and the third system voltage, wherein the bandgap reference voltage circuit is configured to change the reference voltage output at the second node in accordance with the chip temperature.

8. The power amplifier according to claim 7, wherein the bias circuit further includes an auxiliary circuit electrically coupled to the bias generating circuit, and the auxiliary circuit includes:

a fourteenth transistor having a first end coupled to the bias generating circuit and configured to output a reference current, a second end coupled to the third system voltage through an eleventh resistor, and a third end coupled to the third nodes, wherein the bias generating circuit is configured to receive the third system voltage, the reference voltage and the reference current and generate the operating voltage, and the auxiliary circuit is configured to cause the reference current changes as the chip temperature changes, and the bias generating circuit is configured to change the operating voltage in accordance with the reference voltage and the reference current, such that the driving current approaches the predetermined value as the chip temperature rises.

9. The power amplifier according to claim 8, wherein a resistance of the eleventh resistor is twice of a resistance of the eighth resistor.

10. The power amplifier according to claim 2, wherein the reference voltage circuit includes a bandgap reference voltage circuit, including:

a second amplifier having a first input end coupled to the first system voltage through a twelfth resistor, a second input end coupled to the first system voltage through a thirteenth resistor, and an output end coupled to a fourth node;

a fifteenth transistor having a first end coupled to the first input end of the second amplifier, a second end coupled to a common end, and a third end coupled to the first end of the fifteenth transistor; and a sixteenth transistor having a first end coupled to the second input end of the second amplifier through a fourteenth resistor, a second end coupled to the common end, and a third end coupled to the first end of the sixteenth transistor;

wherein the bandgap reference voltage circuit is configured to change the reference voltage output at the fourth node according to the chip temperature.

11. The power amplifier according to claim 10, wherein the bias circuit further includes an auxiliary circuit electrically coupled to the bias generating circuit, and the auxiliary circuit includes:

a seventeenth transistor having a first end coupled to the bias generating circuit and configured to output a reference current, a second end coupled to the common end, and a third end coupled to the first end of the sixteenth transistor, wherein the bias generating circuit is configured to receive the second system voltage, the reference voltage and the reference current and generate the operating voltage; and wherein the auxiliary circuit is configured to cause the reference current changes as the chip temperature changes, and the bias generating circuit is configured to change the operating voltage in accordance with the reference voltage and the reference current, such that the driving current approaches the predetermined value as the chip temperature rises.

12. The power amplifier according to claim 10, wherein the bias circuit further includes an auxiliary circuit electrically coupled to the bias generating circuit, and the auxiliary circuit includes:

an eighteenth transistor having a first end coupled to the bias generating circuit and configured to output a reference current, a second end coupled to the common end, and a third end coupled to the first end of the fifteenth transistor, wherein the bias generating circuit is configured to receive the second system voltage, the reference voltage and the reference current and generate the operating voltage; and wherein the auxiliary circuit is configured to cause the reference current changes as the chip temperature changes, and the bias generating circuit is configured to change the operating voltage in accordance with the reference voltage and the reference current, such that the driving current approaches the predetermined value as the chip temperature rises.

13. The power amplifier according to claim 1, wherein the bias circuit further includes an auxiliary circuit electrically coupled to the bias generating circuit and configured to change a reference current, wherein the bias generating circuit is further configured to receive the second system voltage, the reference voltage, and the reference current and generate the operating voltage, wherein the auxiliary circuit is configured to cause the reference current changes as the chip temperature changes, and wherein the bias generating circuit is configured to change the operating voltage in accordance with the reference voltage and the reference current, such that the driving current approaches the predetermined value as the chip temperature rises.

14. A temperature compensation method for a power amplifier for compensating a driving current of the power amplifier, wherein the power amplifier is configured to amplify a received input signal and includes a bias circuit and an output stage circuit, the bias voltage circuit includes a reference voltage circuit and a bias generating circuit, and the temperature compensation method comprising:

configuring the reference voltage circuit to receive a first system voltage and provide a reference voltage according to the first system voltage, wherein the reference voltage changes as a chip temperature changes;

configuring the bias generating circuit to receive a second system voltage and the reference voltage, and generate an operating voltage;

configuring the output stage circuit to receive the operating voltage and a driving current to receive and amplify the input signal; and configuring, the bias generating circuit to change the operating voltage according to the reference voltage in responsive to the chip temperature changes, such that the driving current approaches a predetermined value as the chip temperature rises.

15. The temperature compensation method for the power amplifier according to claim 14, wherein the bias generating circuit includes:

a first transistor having a first end configured to receive the second system voltage, a second end coupled to the output stage circuit through a bias resistor, and a third end configured to receive the reference voltage through a first resistor.

16. The temperature compensation method for the power amplifier according to claim 15, wherein the reference voltage circuit includes a bandgap reference voltage circuit including:

a fourth transistor having a first end coupled to the first system voltage, a second end coupled to the first system voltage through a second resistor, and a third end coupled to a first node;

a third resistor having one end coupled to the first node;

a fourth resistor having one end coupled to the first node;

a fifth transistor having a first end coupled to another end of the third resistor;

a sixth transistor having a first end coupled to another end of the fourth resistor and a third end short-circuited to the first end of the sixth transistor and coupled to the first end of the fifth transistor;

a current mirror circuit coupled to the second end of the fifth transistor, a second end of the sixth transistor and a common end, wherein the current mirror circuit includes a plurality of seventh transistors, and the bandgap reference voltage circuit is configured to change the reference voltage output at the first node according to the chip temperature;

an eighth transistor having a first end coupled to the first node and a third end coupled between another end of the third resistor and the first end of the fifth transistor; and a ninth transistor having a first end coupled to a second end of the eighth transistor, a second end coupled to the common end, and a third end short-circuited to the first end of the ninth transistor;

wherein the bias circuit further includes an auxiliary circuit electrically coupled to the bias generating circuit, configured to change a reference current; wherein the bias generating circuit is further configured to receive the second system voltage, the reference voltage, and the reference current and generate the operating voltage; wherein the auxiliary circuit is configured to cause the reference current changes as the chip temperature changes; wherein the bias generating circuit is configured to change the operating voltage in accordance with the reference voltage and the reference current, such that the driving current approaches the predetermined value as the chip temperature rises; and wherein the auxiliary circuit includes:

a tenth transistor having a first end configured to provide the reference current and a third end coupled to the third end of the sixth transistor; and a plurality of eleventh transistors each having a third end coupled to the current mirror circuit.

17. The temperature compensation method for the power amplifier according to claim 16, wherein the reference current is changed according to a ratio of a number of the eleventh transistors to a number of the seventh transistors, and the chip temperature.

18. The temperature compensation method for the power amplifier according to claim 15, wherein the reference voltage circuit includes a bandgap reference voltage circuit, including:

a first amplifier having a first input end coupled to the first system voltage through a fifth resistor, a second input end coupled to the first system voltage through a sixth resistor, and an output end coupled to a second node;

a twelfth transistor having a first end coupled to the first input end of the first amplifier, a second end coupled to a seventh resistor, and a third end coupled to a third node;

a thirteenth transistor having a first end coupled to the second input end of the first amplifier, a second end coupled to another end of the seventh resistor, and a third end coupled to the third node;

an eighth resistor coupled to the another end of the seventh resistor and a third system voltage;

a ninth resistor coupled between the second node and the third node; and a tenth resistor coupled between the third node and the third system voltage, wherein the bandgap reference voltage circuit is configured to change the reference voltage output at the second node in accordance with the chip temperature; wherein the bias circuit further includes an auxiliary circuit electrically coupled to the bias generating circuit, and the auxiliary circuit includes:

a fourteenth transistor having a first end coupled to the bias generating circuit and configured to output a reference current, a second end coupled to the third system voltage through an eleventh resistor, and a third end coupled to the third nodes, wherein the bias generating circuit is configured to receive the third system voltage, the reference voltage and the reference current and generate the operating voltage; and wherein the auxiliary circuit is configured to cause the reference current changes as the chip temperature changes, and the bias generating circuit is configured to change the operating voltage in accordance with the reference voltage and the reference current, such that the driving current approaches the predetermined value as the chip temperature rises.

19. The temperature compensation method for the power amplifier according to claim 15, wherein the reference voltage circuit includes a bandgap reference voltage circuit, including:

a second amplifier having a first input end coupled to the first system voltage through a twelfth resistor, a second input end coupled to the first system voltage through a thirteenth resistor, and an output end coupled to a fourth node;

a fifteenth transistor having a first end coupled to the first input end of the second amplifier, a second end coupled to a common end, and a third end coupled to the first end of the fifteenth transistor; and a sixteenth transistor having a first end coupled to the second input end of the second amplifier through a fourteenth resistor, a second end coupled to the common end, and a third end coupled to the first end of the sixteenth transistor;

wherein the bandgap reference voltage circuit is configured to change the reference voltage output at the fourth node according to the chip temperature; and wherein the bias circuit further includes an auxiliary circuit electrically coupled to the bias generating circuit, and the auxiliary circuit includes:

a seventeenth transistor having a first end coupled to the bias generating circuit and configured to output a reference current, a second end coupled to the common end, and a third end coupled to the first end of the sixteenth transistor, wherein the bias generating circuit is configured to receive the third system voltage, the reference voltage and the reference current and generate the operating voltage; and wherein the auxiliary circuit is configured to cause the reference current changes as the chip temperature changes, and the bias generating circuit is configured to change the operating voltage in accordance with the reference voltage and the reference current, such that the driving current approaches the predetermined value as the chip temperature rises.

20. The temperature compensation method for the power amplifier according to claim 15, wherein the reference voltage circuit includes a bandgap reference voltage circuit including:

a second amplifier having a first input end coupled to the first system voltage through a twelfth resistor, a second input end coupled to the first system voltage through a thirteenth resistor, and an output end coupled to a fourth node;

a fifteenth transistor having a first end coupled to the first input end of the second amplifier, a second end coupled to a common end, and a third end coupled to the first end of the fifteenth transistor; and a sixteenth transistor having a first end coupled to the second input end of the second amplifier through a fourteenth resistor, a second end coupled to the common end, and a third end coupled to the first end of the sixteenth transistor;

wherein the bandgap reference voltage circuit is configured to change the reference voltage output at the fourth node according to the chip temperature; and wherein the bias circuit further includes an auxiliary circuit electrically coupled to the bias generating circuit, and the auxiliary circuit includes:

an eighteenth transistor having a first end coupled to the bias generating circuit and configured to output a reference current, a second end coupled to the common end, and a third end coupled to the first end of the fifteenth transistor, wherein the bias generating circuit is configured to receive the third system voltage, the reference voltage and the reference current and generate the operating voltage; and wherein the auxiliary circuit is configured to cause the reference current changes as the chip temperature changes, and the bias generating circuit is configured to change the operating voltage in accordance with the reference voltage and the reference current, such that the driving current approaches the predetermined value as the chip temperature rises.

* * * * *